US005902094A

United States Patent [19]

Hoenisch et al.

[11] Patent Number: 5,902,094

[45] Date of Patent: May 11, 1999

[54] FLOW CONTROL VALVE FOR A PRESSURE WASHER

[75] Inventors: Herb Hoenisch; Robert D. Kern, both of Waukesha; Gerald C. Ruehlow, Oconomowoc; Wes Sodemann, Dousman; Fred Yang, Wauwatosa, all of Wis.

[73] Assignee: Generac Portable Products, LLC, Jefferson, Wis.

[21] Appl. No.: 08/780,406

[22] Filed: Jan. 9, 1997

[51] Int. Cl.[6] ..... F04B 49/03; F04B 49/22

[52] U.S. Cl. ..... 417/26; 417/279; 417/507; 417/510; 137/540; 137/543.19

[58] Field of Search ..... 137/540, 543.19, 137/505, 557; 417/510, 507, 279, 26; 222/491; 239/527, 533.8, 533.9

[56] References Cited

U.S. PATENT DOCUMENTS

| | | | |
|---|---|---|---|
| 1,309,362 | 7/1919 | Lehmann . | |
| 1,475,697 | 11/1923 | Hartman . | |
| 3,039,833 | 6/1962 | Farkas | 309/1 |
| 3,118,030 | 1/1964 | Palen | 200/82 |
| 3,419,692 | 12/1968 | Palen | 200/82 |
| 3,448,757 | 6/1969 | Mercier | 137/108 |
| 4,081,621 | 3/1978 | Hartley | 200/83 Q |
| 4,182,354 | 1/1980 | Bergstedt | 137/10 |
| 4,336,627 | 6/1982 | Bascus | 15/321 |
| 4,851,724 | 7/1989 | Polk et al. | 310/68 A |
| 5,136,128 | 8/1992 | Thomas | 200/81.9 R |
| 5,186,142 | 2/1993 | Brunelli et al. | 123/339 |
| 5,292,232 | 3/1994 | Krohn et al. | 417/44 A |
| 5,529,460 | 6/1996 | Eihusen et al. | 417/20 |

FOREIGN PATENT DOCUMENTS 2 071 783 1/1981 United Kingdom .

*Primary Examiner*—Charles G. Freay
*Assistant Examiner*—Daniel E. Moses
*Attorney, Agent, or Firm*—Jansson, Shupe, Bridge & Munger. Ltd.

[57] ABSTRACT

A pressure washer is powered by a prime mover, e.g., an electric motor or an internal combustion engine, and has a flow control valve. The valve has a housing containing a piston assembly and the assembly has a mechanism coupled to it for controlling prime mover power. The piston assembly includes a first piston sealing against the housing and dividing the housing interior into two chambers. Such first piston is spring-biased to a first position during periods when no output flow is being demanded from the washer. The assembly also has a second piston spring-biased to seal against the first piston during periods of no flow. When flow is demanded by opening the nozzle, the pressure in the second chamber diminishes. And when the difference between the pressure in the second chamber and that in the first chamber exceeds a predetermined value, the assembly shifts to a second position, causing the mechanism to actuate the prime mover.

15 Claims, 4 Drawing Sheets

FLOW CONTROL VALVE FOR A PRESSURE WASHER

FIELD OF THE INVENTION

This invention relates generally to power plants and, more particularly, to pressure washers supplying high pressure liquid, e.g., water, from a hose.

BACKGROUND OF THE INVENTION

Pressure washers are in common use and find utility for washing truck bodies, walls of buildings, sidewalks, removing paint and stain and a host of other applications where high pressure liquid such as water is applied to a surface. A known type of pressure washer includes an electric motor driving a water pump, the source of water for which may be a garden hose. A high pressure hose extends from the pump to a hand-operated nozzle manipulated by the user to start and stop the flow of water.

Water-type pressure washers are often configured in one of two arrangements. In the first, a bypass valve recirculates water to the pump inlet when the user closes the nozzle to stop the flow of water. A feature of this arrangement is that the user, who may be some distance from the washer, need not return to the washer to shut off the motor.

But as a consequence, the electric motor runs continuously and electrical power is wasted during periods when no water is being demanded. In addition, wear on the pump and motor is increased, thus reducing service life. And the washer construction is made more complex in that additional components are needed to control heat buildup due to water recirculating at elevated pressure.

And there is another disadvantage of the arrangement described above. If the user neglects to connect a source of water to the pressure washer while the electric motor is running, the pump operates dry and serious damage can result.

Another known arrangement addresses the matters of wasted electrical power and increased wear by extending a two-wire electrical cable to a motor on-off switch adjacent to the nozzle. When the nozzle is closed to shut off the flow of water, the switch is actuated to turn off the motor. Disadvantages of this arrangement include the need to run the electrical cable to the nozzle and the fact that an electrical switch (probably operating at line voltage) is adjacent to such nozzle.

An improved pressure washer flow control valve which addresses and resolves disadvantages of known arrangements and which is useful with washers having engine or electric motor prime movers would be an important advance in the art.

OBJECT OF THE INVENTION

It is an object of the invention to provide a flow control valve which overcomes some of the problems and shortcomings of known pressure washer configurations.

Another object of the invention is to provide a flow control valve which controls a pressure washer to conserve electrical power.

Another object of the invention is to provide a flow control valve which avoids motor and pump wear during periods when no water is being demanded from the washer.

Yet another object of the invention is to provide a flow control valve which prevents the pressure washer pump from running dry.

Another object of the invention is to provide a flow control valve which helps avoid pump overheating.

Still another object of the invention is to provide a flow control valve which obviates the need to run electrical cable to the nozzle of the pressure washer.

Another object of the invention is to provide a flow control valve which is useful with pressure washers having engines or electric motors as prime movers. How these and other objects are accomplished will become apparent from the following descriptions and from the drawings.

SUMMARY OF THE INVENTION

The invention involves a valve for controlling the flow of water from a prime-mover-powered pressure washer. The valve includes a generally cylindrical housing in which is mounted a piston assembly having coacting first and second pistons. The assembly has a mechanism, e.g., a rod and switch, coupled to it for controlling prime mover power.

More specifically, the first piston is mounted for sliding movement in the housing, seals against such housing and divides the housing interior into first and second pressure chambers. There is a flow passage extending between the pressure chambers. The first piston is spring biased to a first position and moves between the first position and a second position.

The piston assembly also has a second piston, the head of which fits in a cavity in the first piston. The second piston is also spring biased to a first position and in such position, the head seals against a sealing surface of the cavity.

When no flow is being demanded from the pressure washer, the assembly is at a standby position and in such standby position, the first and second pistons are in their respective first positions. In the standby position, the mechanism prevents prime mover power from being transferred to the pressure washer pump. Several arrangements involving different types of prime movers and control thereof are described in the detailed description.

The pressure in the second chamber relative to the pressure in the first chamber is a function of whether or not flow is being demanded from the pressure washer. When no flow is needed, the pressure in the second chamber is substantially equal to the pressure in the first chamber. But when flow is being demanded, the pressure in the second chamber is less than that in the first chamber by at least some predetermined value.

Stated in other words, the assembly is in its first or standby position when the difference between the pressure in the second chamber and the pressure in the first chamber is less than a predetermined value. And the assembly is in its second or operating position when the difference between the pressure in the second chamber and the pressure in the first chamber is greater than a predetermined value. When the assembly is in the operating position, the head of the second piston is spaced from the sealing surface of the first piston.

In another aspect of the invention, the mechanism includes an actuator device, e.g., a rod, extending through the housing and a control device coacting with the actuator device for controlling power to the washer. If the prime mover is an electric motor, the control device is preferably an electric switch for starting and stopping the motor. Or the electric switch may control a clutch interposed between the pump and any type of prime mover. And another approach involves using a control device to regulate the setting of the governor of an internal combustion engine.

A new method for controlling power transmitted from a prime mover to a pressure washer pump includes the steps of providing a flow control valve having a housing and a high pressure hose connected to the housing and terminated in a nozzle having open and closed positions. A piston assembly divides the housing interior into first and second pressure chambers and the hose is in flow communication with the second chamber.

A mechanism is coupled to the assembly and has operating and standby positions for controlling prime mover power. The mechanism is retained in the standby position when the difference between the pressure in the second chamber and the pressure in the first chamber is less than a predetermined value. And the mechanism is moved to the operating position when the difference between the pressure in the second chamber and the pressure in the first chamber is greater than a predetermined value.

In a more specific aspect of the method, the retaining step includes maintaining the user-operated nozzle in its closed position. And the moving step includes manipulating the nozzle to the open position.

In another aspect of the method, the prime mover is an electric motor and the moving step includes applying electrical power to the motor. In the alternative, the moving step includes engaging a clutch interposed between the prime mover and the pump or includes resetting the governor on the prime mover.

Other details of the invention are set forth in the following detailed description and in the drawings.

DETAILED DESCRIPTION OF PREFERRED EMBODIMENTS

Figure 1:
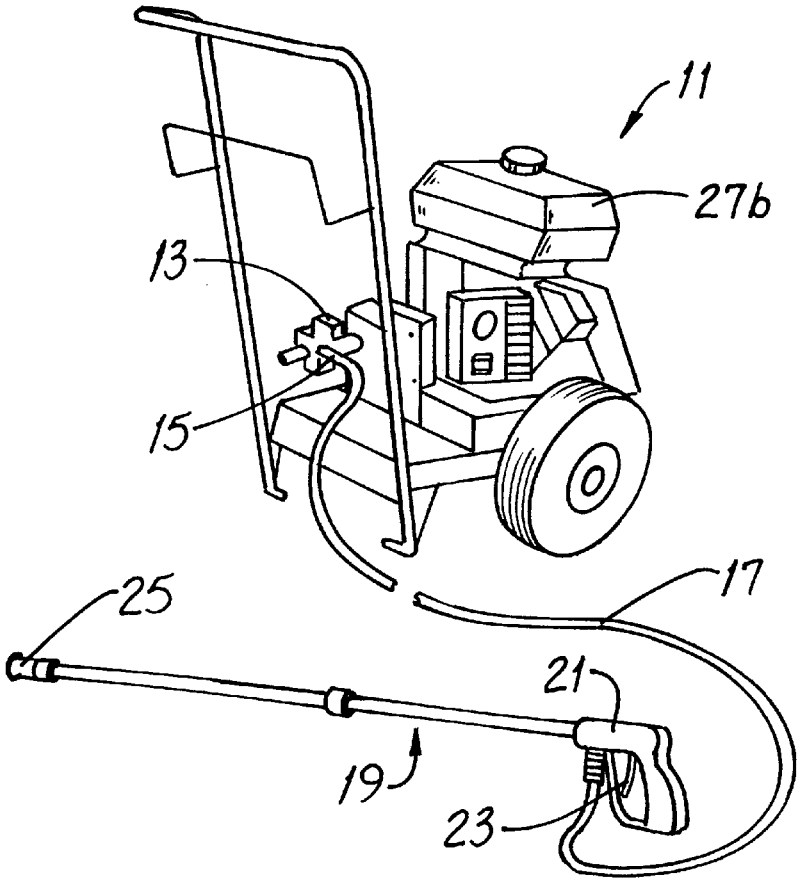
FIG. 1 is a perspective view of an exemplary pressure washer. Parts are broken away.
Figure 2:
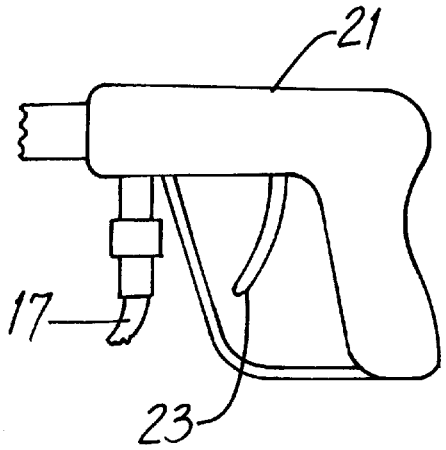
FIG. 2 is a representative side elevation view of the pressure washer hand-grip piece with the on/off lever shown in the "off" position. Parts are broken away.
Figure 3:
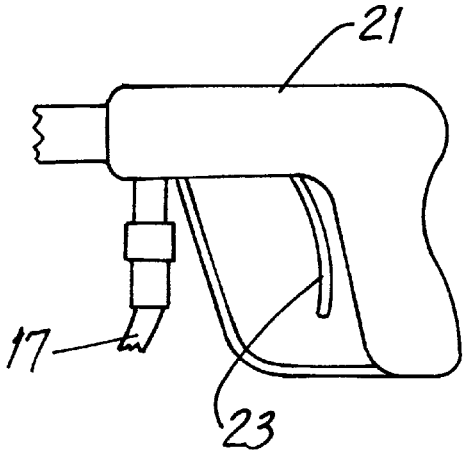
FIG. 3 is a representative side elevation view of the pressure washer hand-grip piece with the on/off lever shown in the "on" position. Parts are broken away.

Before describing the new flow control valve 10 and method, it will be helpful to have an understanding of some of the features of a pressure washer 11. Referring to FIGS. 1, 2 and 3, a pressure washer 11 has a high pressure water pump 13, a source of "input water" for which may be a garden hose. Water is delivered from a pump outlet 15 to a high pressure hose 17 terminated by a wand-like nozzle 19, a specific embodiment of which includes a "gun-like" user-controlled handgrip piece 21 with lever 23. (As used in this specification, the term "nozzle" means any device or mechanism manipulated by the user, e.g., the handgrip piece 21 and lever 23, to turn water flow on and off.)

Unless water is being demanded, the nozzle 19 is normally closed. When the user needs high pressure water from the nozzle 19, s/he manipulates the nozzle 19 to its open position and water is expelled from the outlet piece 25 to the atmosphere.

Figure 4:
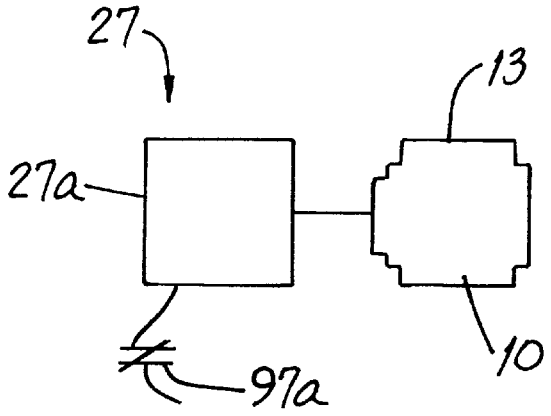
FIG. 4 is a symbolic representation of a prime mover embodied as an electric motor and driving a pressure washer pump.
Figure 5:
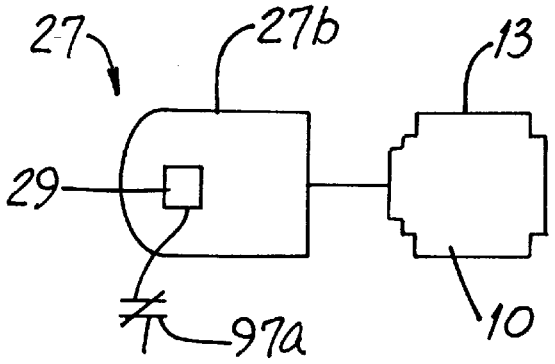
FIG. 5 is a symbolic representation of a prime mover embodied as a governor-equipped internal combustion engine driving a pressure washer pump.
Figure 6:
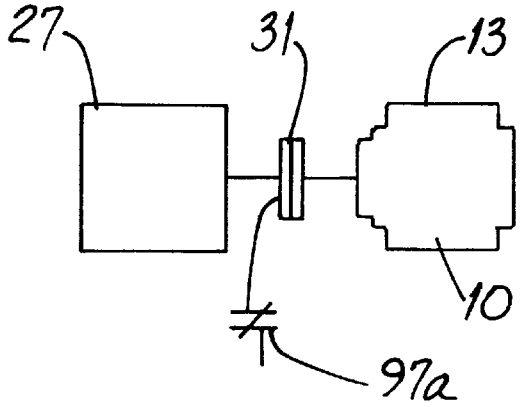
FIG. 6 is a symbolic representation of a prime mover embodied driving a pressure washer pump through a clutch which may be engaged or disengaged.

The pressure washer 11 also has a prime mover 27 such as an electric motor 27*a* or an internal combustion engine 27*b*. FIG. 4 shows the pump 13 driven by a prime mover 27 embodied as an electric motor 27*a* while FIG. 5 shows such pump 13 driven by a prime mover 27 embodied as an internal combustion engine 27*b*. In the arrangement of FIG. 5, the engine 27*b* has a governor 29 and in a specific aspect of the invention described below, the new valve 10 is used to establish the governor setting. FIG. 6 shows another arrangement involving a prime mover 27 and a pump 13 with a clutch 31 interposed between them. In another specific aspect of the invention, the new valve 10 is used to engage or disengage the clutch 31.

When considering the following specification, the convenience of operation afforded by the new valve 10 will be better appreciated by recognizing that the hose 17 may be quite long. That is, there may be a substantial distance between the nozzle 19 and the prime mover 27.

Figure 7:
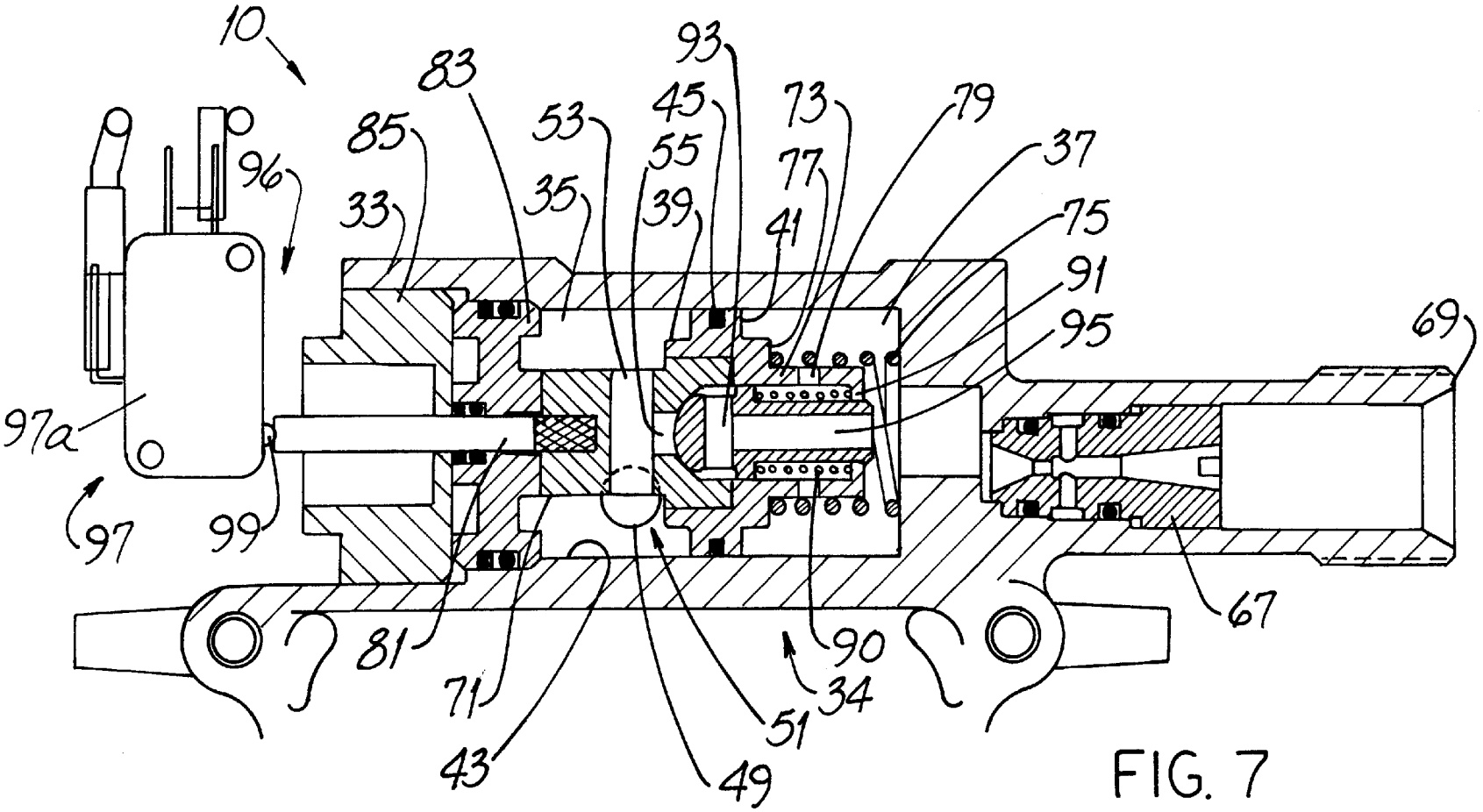
FIG. 7 is a cross-sectional view of the new flow control valve in its prime-mover-standby position.
Figure 8:
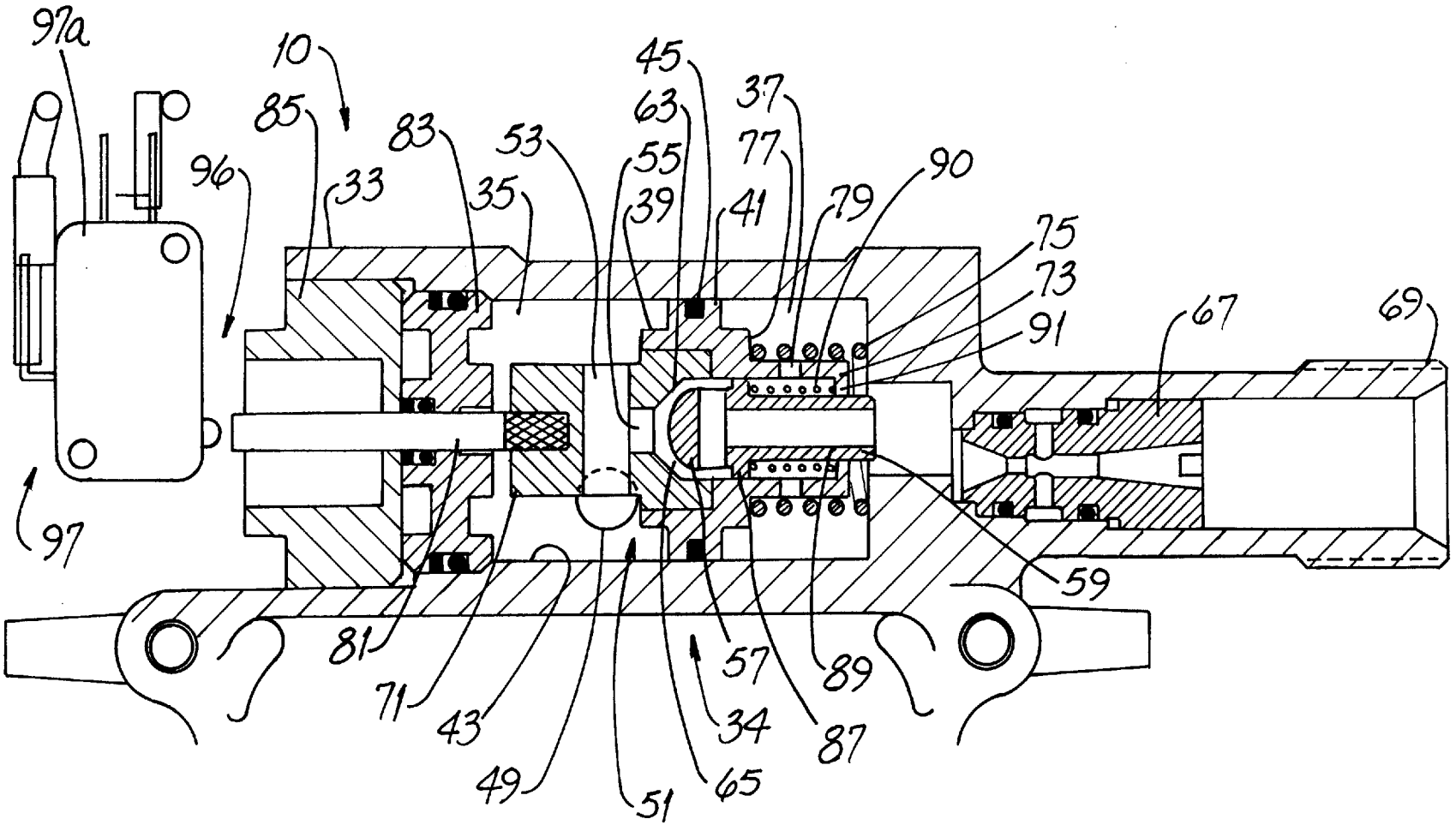
FIG. 8 is a cross-sectional view of the new flow control valve in its prime-mover-operating position.

Referring next to FIGS. 7 and 8, details of the new valve 10 and of its operation will now be set forth. The valve 10 has a generally cylindrical housing 33, the interior of which is divided by a piston assembly 34 into a first chamber 35 and a second chamber 37. Such assembly 34 includes a first piston 39 having a rim portion 41, the perimeter of which is in sliding engagement with the interior wall 43. Sealing between the rim portion 41 and the wall 43 is effected by a wiper seal 45.

The valve 10 has an inlet port 49 in flow communication with the first chamber 35. Understanding the operation of the valve 10 (which is set out in detail below) will be aided by appreciating two aspects of the valve 10 and the pressure washer 11. One is that if a garden hose is attached to the pump 13 and the sill cock is turned on but the prime mover 27 is inoperative, water flows to the first chamber 35 and the pressure in such chamber 35 is substantially equal to tap pressure, e.g., 40–60 psi. On the other hand, when the prime mover 27 starts to drive the pump 13, a check valve "stops off" the low-pressure flow path and the pressure in the chamber 35 rises to, nominally, pump outlet pressure, e.g., over 1000 psi.

The first piston 39 also has a flow passage 51 extending between the chambers 35, 37. Such passage 51 comprises a cross-bore 53 and an axial bore 55 in flow communication with one another. When, as shown in FIG. 8, the head 57 of the second piston 59 is away from the sealing surface 63 in the cavity 65 of the first piston 39, water is permitted to flow through the second piston 59, the mixing venturi 67 (if the washer 11 is so equipped), and the outlet 69 to the hose 17. (It is to be appreciated that the piston 39 is shown to include a separate body 71 and rim portion 41 only for purposes related to manufacturing. Once assembled, the body 71 and rim portion 41 are fixed with respect to one another.)

The first piston 39 also has a guide 73 which supports a first compression spring 75. One end of the spring 75 bears against the housing wall 43 and the other spring end bears against a shoulder 77 on the piston 39. The spring 75 urges the first piston 39 in a first direction, i.e., leftward in the views of FIGS. 7 and 8, and in—in place thereof. The absence of a countervailing force, the spring 75 urges the first piston 39 to the first position shown in FIG. 7. The guide 73 has at least one aperture 79 providing flow communication between the second chamber 37 and the cavity 65 of the first piston 39.

The first piston 39 also has an actuator device 81 attached to the piston 39 and extending through an opening in a piston stop 83 and through another opening in a piston cap 85. The stop 83 seals against the wall 43 and once assembled there, does not move. Similarly, the cap 85 is fixed in place during valve assembly and does not move during operation of the valve 10. The manner in which the actuator device 81 is used to control prime mover power to the pump 13 is explained below.

Referring further to FIGS. 7 and 8, the piston assembly 34 also includes the second piston 59 having a hemispherical head 57, a guide rim 87 and a stem 89. The head 57 is urged in the first direction (leftward in the views of FIGS. 7 and 8) against the surface 63 by the second spring 90. When the second piston 59 moves relative to the first piston 39, the guide rim 87 slides along the surface of the cavity 65. A second point of support for the piston 59 is provided by a guide lip 91 formed on the first piston 39. The diameter of the opening defined by the lip 91 and the diameter of the stem 89 are cooperatively sized for sliding clearance therebetween.

The second piston 59 has a flow path which includes a cross hole 93 and an axial hole 95 which are in flow communication with one another. It is to be noted that when the second piston 59 is in its first position as shown in FIG. 7, the piston head 57 seals against the surface, preventing water flow from the first chamber 35 through the flow passage 51 to the second chamber 37 or beyond. And when the second piston 59 is in the second position as shown in FIG. 8, the head 57 is away from the surface 63 and water is free to flow through the passage 51, through the path defined by holes 93, 95 and beyond.

Referring to FIGS. 4 through 8, the washer 11 has a mechanism 96 comprising control device 97 coacting with the actuator device 81 for controlling power to the washer 11. If the prime mover 27 is an electric motor 27*a*, the control device 97 is preferably an electric switch 97*a* for starting and stopping the motor 27*a*. Or the electric switch 97*a* may control a clutch 31 as shown in FIG. 6. And another approach involves using a control device 97 such as a switch 97*a* to regulate the setting of the governor 29 of an internal combustion engine 27*b* as shown in FIG. 5.

In a specific embodiment, the electric switch 97*a* is normally closed and when the prime mover 27 is an electric motor 27*a*, the switch 97*a* is in series with the motor 27*b* as shown in FIG. 4 or is in series with the coil of a relay, the contacts of which control the motor 27*b*.

Operation

For the first part of this description, it is assumed that the pressure washer 11 has never been used and that neither the chambers 35, 37 nor the outlet 69 or hose 17 contain any water. It is also assumed that the chambers 35, 37, outlet 69 and hose 17 are at ambient air pressure, i.e., 0 psi gauge, and that the nozzle 19 and its piece 21 are closed as shown in FIG. 2 wherein the lever 23 is in the "off" position.

Under those conditions, the springs 75, 90 bias the pistons 39, 59 leftwardly (as viewed in FIGS. 7 and 8), the actuating device 81 depresses the button 99 of the normally-closed switch 97*a*, thereby opening it. Therefore, the valve 10 and mechanism 96 are in the standby position and the prime mover 27 is unable to provide driving power to the pump 13.

When a garden hose is connected to the pump 13 prior to driving the pump 13 with a prime mover 27, the first chamber 35 fills with water at, e.g., 60 psi. Since the second chamber 37 is then nominally at zero psi, the force of the springs 75, 90 is overcome, both pistons 39, 59 move rightwardly, the device 81 moves away from the switch 97*a* and the mechanism 96 thus assumes its operating position. The switch 97*a* is thereby actuated to cause the prime mover 27 to provide driving power to the pump 13.

The pump 13 thereupon fills both chambers 35, 37, the outlet 69 and the hose 17 with water at high pressure. (By a known construction, the nozzle 19 permits air in the hose 17 to vent to atmosphere but does not permit water to pass therethrough unless the nozzle 19 is intentionally opened.) With the pressure in both chambers 35, 37 now substantially equalized at some high pressure (i.e., well above tap water pressure), the springs 75, 90 urge the pistons 39, 59 leftwardly to their first positions and the valve 10 and the mechanism 96 assume the standby position. (This filling cycle during which the prime mover 27 drives the pump 13 is very brief and may last a few seconds or less.)

It is now assumed that the user wishes to obtain high pressure water from the nozzle 19. The nozzle 19 is opened by moving the lever 23 to the "on" position as shown in FIG. 3, thereby causing the pressure in the hose 17, the outlet 69 and the second chamber 37 to diminish. When the difference in pressure between that in the second chamber 37 and that in the first chamber 35 exceeds a predetermined value, e.g., 75–100 psi, the pistons 39, 59 move to their second positions as shown in FIG. 8 and the valve 10 and mechanism 96 move to the operating position.

When that occurs, the actuating device 81 moves rightwardly away from the control device 97 and the prime mover 27 is caused to power the pump 13. High pressure water flows through the bore 53 and the bore 55, around the head 57 and through the hole 93 and the hole 95 to the outlet 69 and to the nozzle 19 until the nozzle 19 is again shut off.

From the foregoing, it is now apparent that prime mover power to the pump 13 may be controlled by only manipulating the nozzle 19. In other words, the user need not walk from the nozzle 19 to the pressure washer 11 to turn off or otherwise disable the prime mover 27. Steps and time are saved.

And it is also apparent that if the source of water from the exemplary garden hose fails, the pump 13 no longer provides high pressure water to the inlet port 49. Irrespective of whether the nozzle 19 is open or closed, pressures in the chambers 35, 37 soon become about equal to one another, the pistons 39, 59 are spring biased to their first positions and the prime mover 27 is disabled. Thus, the pump 13 is prevented from running dry. The new valve 10 and pump 13 may be plumbed to one another using hoses or the like. However, in a highly preferred embodiment, the valve 10 is an integral part of the pump 13 as indicated in FIGS. 4, 5 and 6.

As used in this specification, terms such as "leftwardly" and "rightwardly" are used solely for purposes of explaining the drawings. Such terms are not intended to be limiting.

While the principles of the invention have been shown and described in connection with a few preferred embodiments, it is to be understood clearly that such embodiments are by way of example and are not limiting. For example, the electric switch 97*a* is described as being normally closed and held open when the valve 10 is in the standby position. Persons of ordinary skill in the art will immediately recognize how to configure a circuit using a normally-open switch. Such variations are clearly within the scope of the invention.

What is claimed is:

1. A flow control valve for a pressure washer having a pump powered by a prime mover and further including a high pressure hose and a nozzle coupled to the flow control valve, the valve including:

a housing having an interior;

a piston assembly in the housing and having a mechanism coupled thereto, such mechanism controlling prime mover power to the pump;

and wherein the piston assembly includes:

a first piston biased by a first spring in a first direction;

the first piston seals against the housing, thereby dividing the housing interior into first and second chambers; and a second piston biased by a second spring in the first direction toward the first piston;

and wherein:

the first and second springs are in the second chamber;

the first chamber is at a first chamber pressure and the second chamber is at a second chamber pressure;

when the nozzle is closed, the first piston is spring-biased to a first position, the first and second chamber pressures are substantially equal to one another and the mechanism prevents the prime mover from transmitting power to the pump;

when the nozzle is open, the pressure in the second chamber is less than the pressure in the first chamber, the first piston is pressure-biased to a second position, and the mechanism permits the prime mover to transmit power to the pump; and when the nozzle is open, the second piston is urged out of sealing engagement with the first piston.

2. The valve of claim 1 wherein:

the first piston includes a guide;

the second piston is in the guide; and the second spring is interposed between the guide and the second piston.

3. The valve of claim 1 wherein:

the first piston includes a guide spaced radially inwardly from the housing; and the first spring is around the guide.

4. The valve of claim 2 wherein:

the guide is spaced radially inwardly from the housing; and the first spring is around the guide.

5. The valve of claim 1 wherein:

the first chamber pressure acts in a second direction opposite the first direction.

6. The valve of claim 5 wherein:

the second chamber pressure acts in the first direction.

7. The valve of claim 1 wherein the mechanism includes:

an actuator device mechanically coupled to the piston assembly and extending through the housing; and a control device coacting with the actuator device for controlling power to the washer.

8. The valve of claim 7 wherein the prime mover is an electric motor and the control device is a normally-closed electric switch for starting and stopping the motor.

9. The valve of claim 7 wherein the control device is a normally-closed electric switch for controlling a clutch.

10. A method for controlling power transmitted from a prime mover to a pressure washer pump and including the steps of:

providing a flow control valve having (a) a housing, (b) a piston assembly mounted for sliding movement in the housing and dividing the housing interior into first and second pressure chambers, (c) a liquid inlet in flow communication with the first chamber irrespective of the position of the piston assembly in the housing, (d) a hose in flow communication with the second chamber and terminated by a nozzle, and (e) a mechanism coupled to the assembly and having operating and standby positions for controlling prime mover power;

retaining the mechanism in the standby position when the difference between the pressure in the second chamber and the pressure in the first chamber is less than a predetermined value; and moving the mechanism to the operating position when the difference between the pressure in the second chamber and the pressure in the first chamber is greater than a predetermined value.

11. The method of claim 10 wherein the nozzle has open and closed positions and the retaining step includes spring-biasing the mechanism to the standby position when the nozzle is in its closed position.

12. The method of claim 10 wherein the nozzle has open and closed positions, and:

the moving step includes pressure-biasing the mechanism to the operating position when the nozzle is in its open position.

13. The method of claim 11 wherein the moving step includes pressure-biasing the mechanism to the operating position when the nozzle is in its open position.

14. The method of claim 10 wherein the mechanism includes a normally-closed electric switch, the prime mover is an electric motor and the moving step includes applying electrical power to the motor by permitting the electric switch to assume its normally-closed position.

15. The method of claim 10 wherein a clutch is interposed between the prime mover and the pump and the moving step includes engaging the clutch by pressure-biasing the mechanism to the operating position.

* * * * *